US005761915A

United States Patent [19]

Rao

[11] Patent Number: 5,761,915

[45] Date of Patent: Jun. 9, 1998

[54] METHOD AND APPARATUS FOR SUPPLYING CONDITIONED FRESH AIR TO AN INDOOR AREA

[75] Inventor: Srikant Ram Rao, Newtown, Pa.

[73] Assignee: Fedders Corporation, Liberty Corner, N.J.

[21] Appl. No.: 816,164

[22] Filed: Mar. 12, 1997

[51] Int. Cl.[6] ..... F25D 17/06

[52] U.S. Cl. ..... 62/94; 62/271; 62/3.2

[58] Field of Search ..... 62/271, 93, 94, 62/3.2, 3.3; 165/8

[56] References Cited

U.S. PATENT DOCUMENTS

| | | |
|---|---|---|
| 5,325,676 | 7/1994 | Meckler . |
| 5,373,704 | 12/1994 | McFadden . |
| 5,502,975 | 4/1996 | Brickley et al. . |
| 5,509,275 | 4/1996 | Bhatti et al. . |
| 5,517,828 | 5/1996 | Calton et al. . |
| 5,548,970 | 8/1996 | Cunningham et al. . |

OTHER PUBLICATIONS

*Energy Conservation Wheel*, Laroche Air Systems Inc., Energy Conservation Wheel (2 pages).

*Primary Examiner*—William Doerrler
*Attorney, Agent, or Firm*—Darby & Darby

[57] ABSTRACT

A housing has a first side and a second side. A first opening is disposed in the first side. A second opening and a third opening are disposed in the second side. An enthalpy wheel has a first side facing surface and an opposite second side facing surface. The enthalpy wheel is rotatably mounted within the housing. Approximately half of the second side facing surface of the enthalpy wheel is in fluid communication with the second opening. Approximately the remaining half of the second side facing surface is in fluid communication with the third opening. Substantially the entire first side facing surface is in fluid communication with the first opening. A first fan is mounted within the housing adjacent to the second opening. A second fan is mounted within the housing adjacent to the third opening. A partition is disposed in the housing between a predetermined location on the second side of the housing between the second opening and the third opening and extends to the enthalpy wheel to define, in part, a first air flow path and a second air flow path within the housing. The first air flow path extends between the second opening through the enthalpy wheel to the first opening. The second air flow path extends between the first opening through the enthalpy wheel to the third opening. In a preferred embodiment, the ratio of air flow through the first air flow path to air flow through the second air flow path ranges from about 65% to about 85%.

35 Claims, 5 Drawing Sheets

METHOD AND APPARATUS FOR SUPPLYING CONDITIONED FRESH AIR TO AN INDOOR AREA

BACKGROUND OF THE INVENTION

1. Field of the Invention

The present invention relates to a method and apparatus for supplying conditioned fresh air to an indoor area. More specifically, the present invention relates to a method and apparatus for supplying conditioned fresh air to an indoor area by using a stand alone housing that includes a rotating enthalpy wheel. Two air flow paths are defined within the housing. The first air flow path brings conditioned fresh air into the indoor area, while the second air flow path removes stale air from the indoor area. In a cooling mode, the incoming fresh air is conditioned by removing moisture and heat from the fresh air and transferring that moisture and heat to the exiting stale air. In the heating mode, the incoming fresh air is conditioned by removing moisture and heat and from the exiting stale indoor air and transferring that moisture and heat to the incoming fresh air.

2. Discussion of the Related Art

In recent years, because the cost of fuel has become relatively expensive, consumers and business alike have been trying to conserve the amount of fuel that they use. Accordingly, both during the heating season and the cooling season, consumers and business people tend to seal up their respective homes and places of business as tightly as possible to control fuel costs. This is especially true of many office buildings, where it is often impossible to open a window to let fresh air into the room. The sealing up of homes and businesses has resulted in "stale air" remaining in the room. In other words, substantially the same air is constantly being recirculated. The stale air could be contaminated with, for example, any one or more of the following:

Fumes from cooking and odors;

Household chemicals and detergents, varnishes, glues, etc.;

Gases from carpet, furniture and building materials;

Dust mites, pet dander and parasites;

Radon aspiration from the basement;

Carbon monoxide/dioxide from gas appliances;

Plant pollen and spores; and/or

Bacteria and viruses.

Since January, 1996, most building codes have had to conform with ASHRAE Standard 62-89. This regulation requires that up to 15 cfm of fresh air per person be drawn into a room. Of course, one simple solution to conform to ASHRAE 62-89 would be to provide each room with appropriate ventilation which removes the indoor, stale air and, separately, allows fresh outdoor air into the room. However, simply ventilating a room with fresh outdoor air, inputs outdoor air that is typically at an unacceptable temperature and humidity level, requiring the increased use of the heating or air conditioning system to at least compensate for the temperature of the incoming fresh air. Accordingly, it is an object of the present invention to provide a stand alone unit that removes stale indoor air from an indoor area and inputs fresh, conditioned outdoor air to the indoor area.

It is a further object of the present invention to condition the incoming fresh air by transferring humidity and heat to or from the indoor air.

SUMMARY OF THE INVENTION

In accordance with a preferred embodiment demonstrating further features, objects and advantages of the present invention, a fresh air supply unit includes a housing having a first side and a second side. A first opening is disposed in the first side; a second opening and a third opening are disposed in the second side. An enthalpy wheel has a first side facing surface and an opposite second side facing surface. The enthalpy wheel is rotatably mounted within the housing. Approximately half of the second side facing surface of the enthalpy wheel is in fluid communication with the second opening. Approximately the remaining half of the second side facing surface is in fluid communication with the third opening. Substantially the entire first side facing surface is in fluid communication with the first opening. A first air flow path and a second air flow path are defined within the housing. The first air flow path extends between the second opening through the enthalpy wheel to the first opening. The second air flow path extends between the first opening through the enthalpy wheel to the third opening.

BRIEF DESCRIPTION OF THE DRAWING FIGURES

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PREFERRED EMBODIMENT

Figure 1:
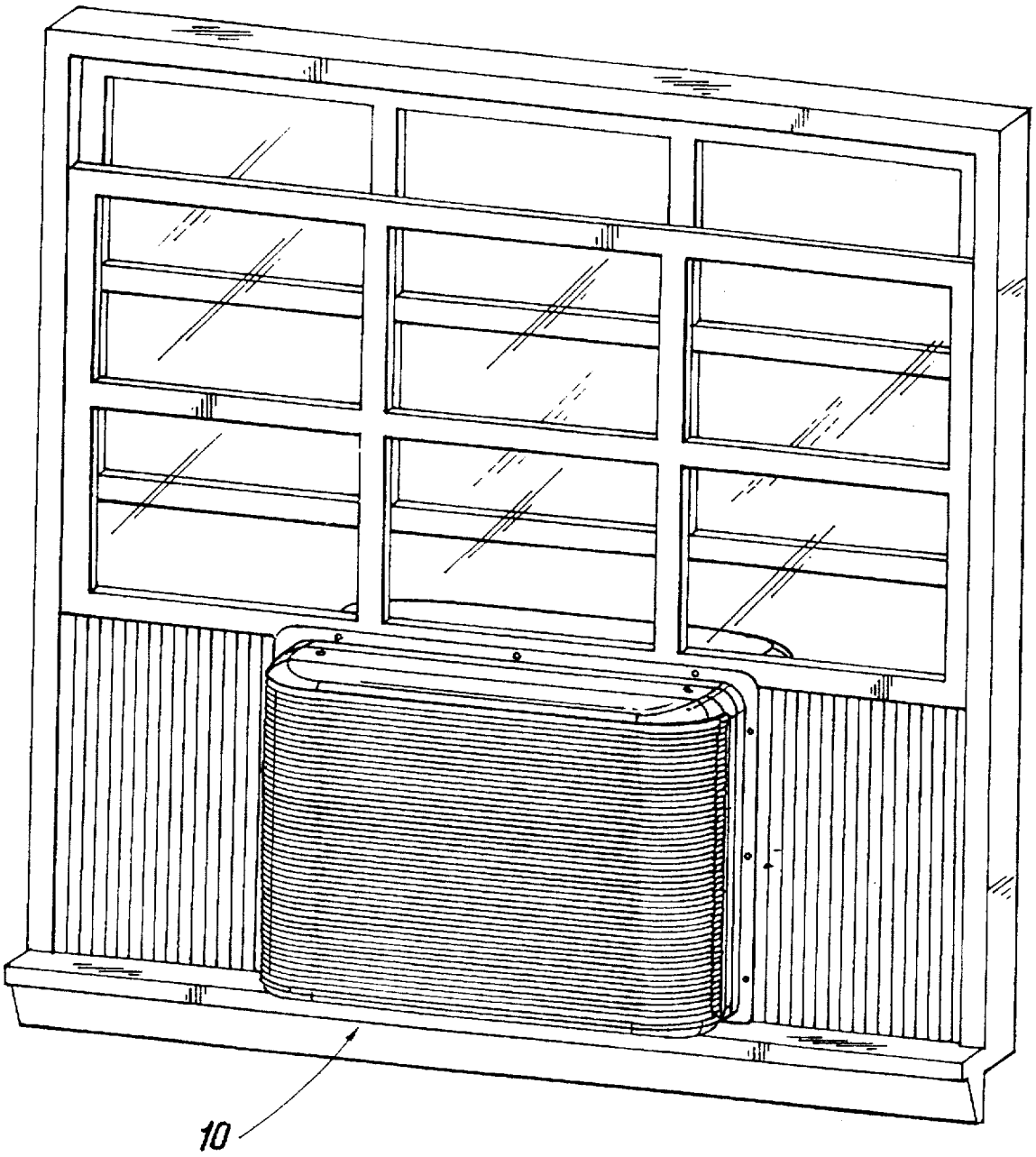
FIG. 1 is a perspective of the fresh air supply unit mounted in a window, as viewed from the indoor side.
Figure 2:
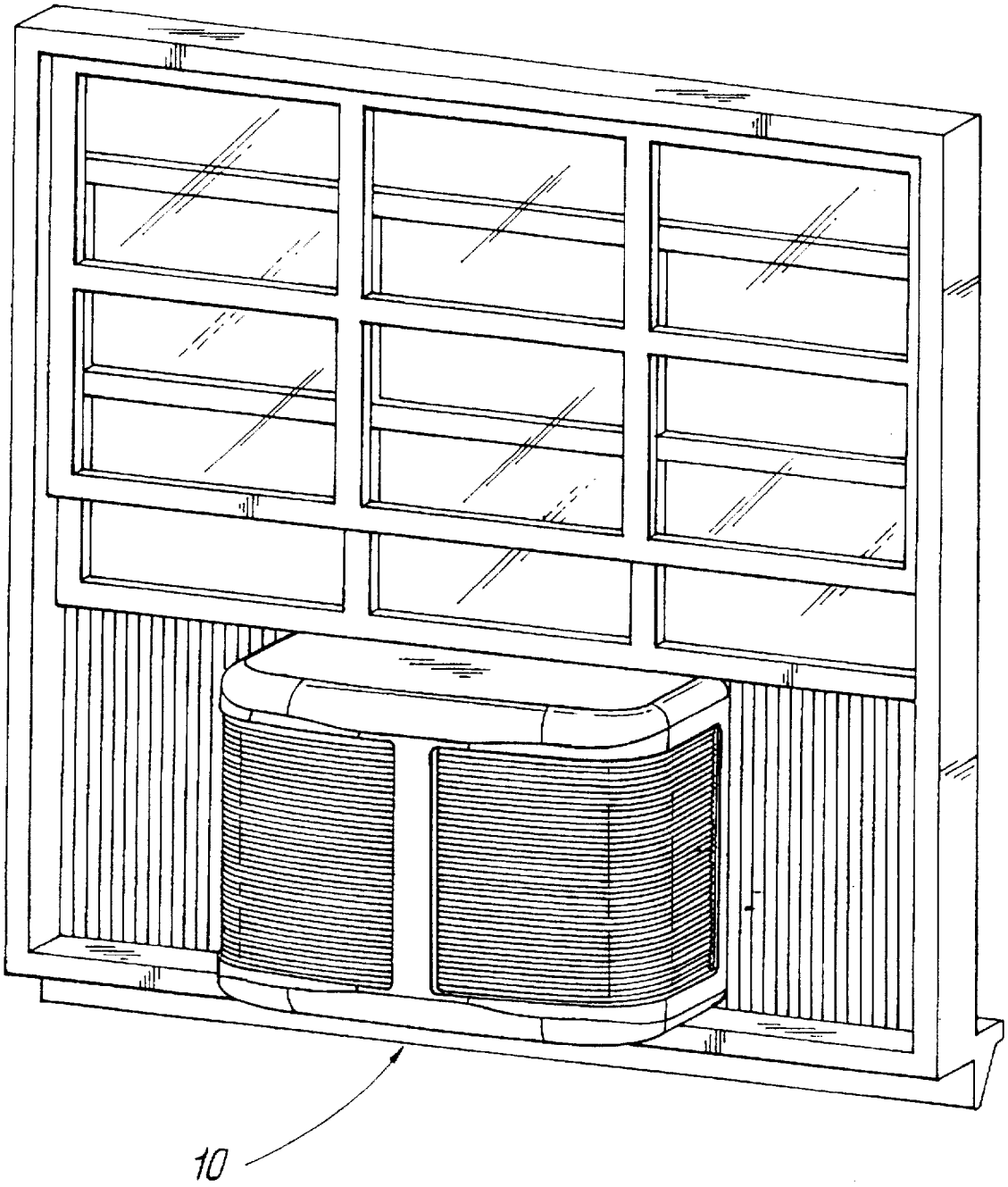
FIG. 2 is a perspective of the fresh air supply unit mounted in a window, as viewed from the outdoor side.
Figure 3:
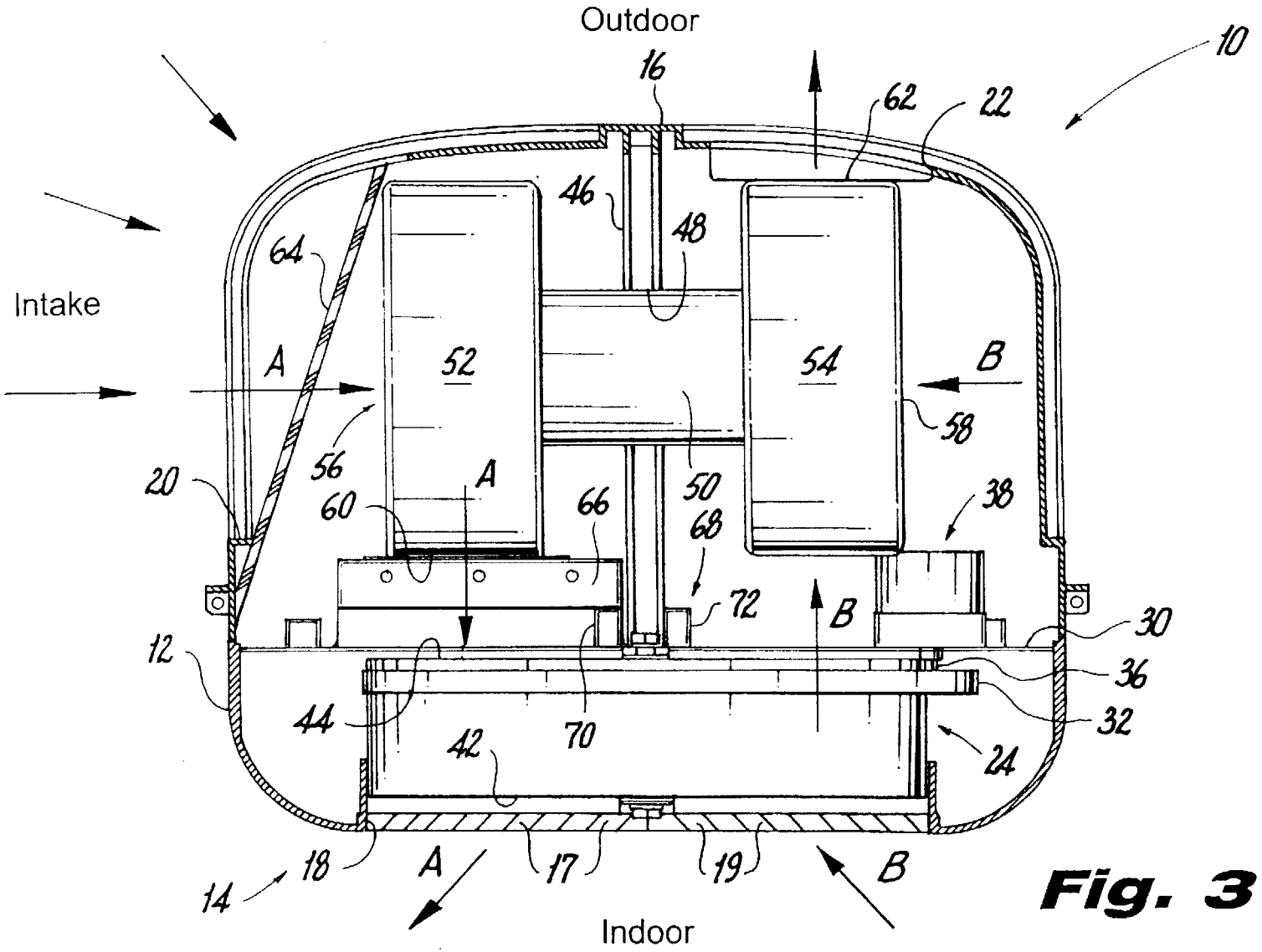
FIG. 3 is a top sectional view of the unit, with parts broken away.

Referring now to FIGS. 1–5, a fresh air supply unit 10 is illustrated. Fresh air supply unit 10 includes a housing 12 having a first indoor side 14 and a second outdoor side 16. A first opening 18 is disposed in first side 14. First opening 18 preferably includes two sets of louvers 17, 19 to direct air out of and into the first side 14 of the housing 12, respectively. A second opening 20 and a third opening 22 are disposed in second side 16.

Figure 4:
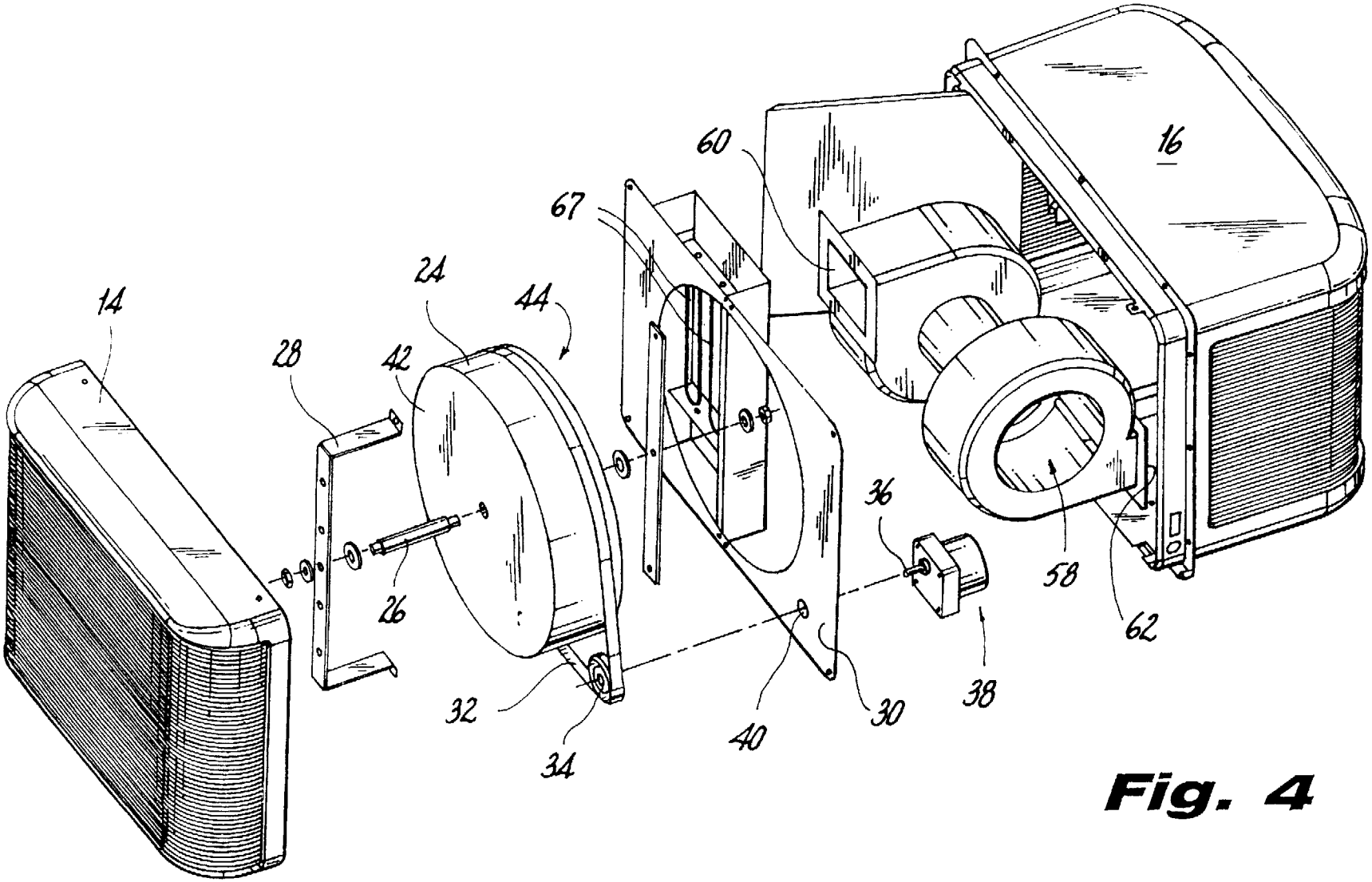
FIG. 4 is an exploded view of the unit.

An enthalpy wheel 24 is rotatably mounted within housing 12. As illustrated in FIG. 4, enthalpy wheel 24 is rotatably mounted about fixed axle 26. Axle 26 is fixedly mounted to a C-shaped bracket 28 that is fixedly mounted to a fixed mounting wall 30. Mounting wall 30 is mounted between the first side 14 of housing 12 and the second side 16 of housing 12. Enthalpy wheel 25 is rotatably driven by, for example, endless belt 32. Belt 32 is driven by drive pulley 34, which is rotatably connected to the rotatable output shaft 36 of drive motor 38. Motor 38 is fixedly mounted to mounting wall 30 within the second side 16 of housing 12. Drive shaft 36 of motor 38 extends through a hole 40 in wall 30 and is drivingly engaged with drive pulley 34, for example, by a keyed connection (not shown). Of course, enthalpy wheel 24 can be rotatably driven by any number of conventional methods. For example, a rubber star wheel could be used to engage the outer cylindrical surface (i.e., rim) of the enthalpy wheel, thereby causing wheel 24 to rotate. In practice, the present inventor has found that such a rotatable coupling will produce an unacceptable amount of noise. Accordingly, it is currently preferred to use a high quality belt and pulley mechanism as the rotatable driver to maintain the noise level at a satisfactorily low level.

Enthalpy wheel 24 is preferably made from a desiccant material that is embedded in a polymer wheel. Therefore, wheel 24 can exchange sensible and latent energy, and can exchange moisture. Enthalpy wheel 24 is commercially available from many suppliers, including LaRoche Air Systems, Baton Rouge, La. as an Energy Conservation Wheel.

Enthalpy wheel 24 has a first side or axial end facing surface 42 and an opposite second side or axial end facing surface 44. Substantially the entire first side facing surface 42 is in fluid communication with the first opening 18 in housing 12. Additionally, approximately half of the second side facing surface 44 is in fluid communication with second opening 20, and approximately the remaining half of the second side facing surface 44 is in fluid communication with third opening 22.

A partition 46 is disposed in housing 12 between a predetermined location, on the second side 16 of housing 12, that is located between the second opening 20 and the third opening 22. Partition 46 extends to the second side facing surface 44 of enthalpy wheel 24. It is noted that partition 46 is not illustrated in the exploded view of FIG. 4 for the sake of clarity. However, it is to be understood that partition 46 includes a throughbore 48 to receive an electric motor 50, which is fixedly mounted within bore 48. Motor 50 is used to simultaneously drive a first fan or squirrel cage blower 52 and a second fan or squirrel cage blower 54. Each fan is preferably a centrifugal type blower that includes an axial inlet 56, 58, respectively, and a radially directed outlet 60, 62, respectively. Partition 46 approximately bisects the second side 16 of the housing.

A filter 64 is disposed within the housing between the second opening 20 and the inlet 56 to first fan 52. Filter 64 can be, for example, a washable electrostatic filter, a disposable filter, or a washable reusable filter.

A heater 66 is disposed in the housing between the exit of first fan 52 and the second side facing surface 44 of enthalpy wheel 24. Heater 66 is preferably fixedly mounted to wall 30. Heater 66 preferably includes a plurality of electric resistance heater elements 67, similar to the type that are used in conventional hairdryers. A temperature sensor (not shown) can be used to automatically turn the heater on and off as is required to raise the temperature of the incoming air to the desired indoor room temperature.

An optional thermoelectric chip 68 is disposed on partition 46. Thermo-electric chip 68 has a first surface 70 disposed on one side of the partition and a second surface 72 disposed on the opposite side of the partition. Thermo-electric chip 68 can be used to either heat or cool the incoming air. In fact, if enough chips are used, the entering air, during a cooling mode, can be reduced to be at the same temperature or one lower than the air being exhausted through the second air flow path (i.e., the indoor air). Thermo-electric modules are, per sé, well known in the art. However, in a preferred embodiment, the thermo-electric module to be used in the present invention is similar to the one disclosed in Applicant's currently pending application Ser. No. 08/713,106, filed Sep. 16, 1996, entitled "Fabrication of Thermo-Electric Modules and Solder For Such Fabrication".

Partition 46, in part, defines a first air flow path A and a second air flow path B through the housing. First air flow path A extends between second opening 20 through first fan 52, through heater 66, through enthalpy wheel 24 and out through first opening 18. Similarly, the second air flow path B extends from first opening 18, through enthalpy wheel 24, through second fan 54, and out through the third opening 22. As air flows out of housing 12, along first air flow path A, louvers 17 direct the exiting air away from an inlet portion of first opening 18, which corresponds to the location of louvers 19. Similarly, louvers 19 ensure that the air entering housing 12 along second air flow path B is not the same air that just entered the room from air flow path A. Therefore, louvers 17, 19 ensure that the air flows within the room, and is not short circuited directly from the outlet portion of first opening 18 (which corresponds to the location of louvers 17) to the inlet portion of first opening 18. Similarly second opening 20 and third opening 22 disposed on the second (or outdoor) side 16 of housing 12 are spaced apart from each other by a predetermined distance to ensure that the air exiting housing 12 from third opening 22 is not short circuited directly to second opening 20 and immediately back into housing 12. Of course, both the second As air flows in the first air flow path A, it contacts first surface 70 of the thermoelectric chip to transfer heat therewith through convection. Similarly, as the air flows in the second air flow path B, it contacts second surface 72 of the thermoelectric chip to also transfer heat therewith through convection. Thermo-electric chip 68 is used to supplement the heating or cooling of the air flow in the first air flow path A, as desired.

In operation, electric motor 50 is actuated to cause both fans 52 and 54 to rotate, thereby establishing a first air flow path A and a second air flow path B. In an exemplary embodiment of the present invention, 115 cubic feet per minute of air flow through the first air flow path A and 150 cubic feet per minute of air flow through second air flow path B. This difference in air flow rate is principally caused by the placement of filter 64 across air flow path A. Filter 64 causes a static pressure drop so less air enters the room than is withdrawn from the room. The ratio of air flow through the first air flow path A to the air flow through the second air flow path B ranges from about 65% to 85% and more preferably the ratio ranges from about 70% to 80%. In an example of the present invention the ratio was 76%. The fresh air supply unit operates more efficiently because more air is flowing along air flow path B than air flow path A. Thus, the rotating enthalpy wheel 24 transfers energy from a greater amount of air in path B during any given period of time than the amount of air in air flow path A during that same period of time. Thus, the air travelling along air flow path A, that is the air entering the indoor room, is able to be conditioned so that its temperature and humidity levels closely approximate that of the indoor room.

Motor 38 is actuated to rotate enthalpy wheel 24. Wheel 24 is preferably rotated at a speed ranging from about 20 to 70 rpm and more preferably at a speed of from about 30 to 60 rpm. In an example of the present invention, enthalpy wheel 24 rotated at 57 rpm. One skilled in the art will recognize that as the rotational speed of wheel 24 varies, the amount of energy (in the form of heat and moisture) that the wheel can absorb and release (i.e., transfer) will also vary. Additionally, the flux of the air flow in both air flow paths A and B will also influence the amount of energy absorbed and released by enthalpy wheel 24.

Typically, the first side 14 of the housing 12 is disposed on the indoor side and the second side 16 of the housing 12 is disposed on the outdoor side. Fresh air passes through the housing along first air flow path A and stale indoor air passes through the housing along air flow path B. In a cooling mode, relatively hot, humid fresh air travels along air flow path A. Thus, as the fresh air passes through enthalpy wheel 24, heat and moisture are transferred to the enthalpy wheel. Because the enthalpy wheel is rotating at a relatively low rate of speed, the heat and moisture absorbed by the enthalpy wheel are then given off to the relatively stale, cool and dry air that is passing through the enthalpy wheel and traveling along air flow path B. In the heating mode, relatively hot, humid indoor stale air travels along air flow path B. Thus, as the stale air passes through the enthalpy wheel 24, heat and moisture are transferred to the rotating enthalpy wheel 24. The enthalpy wheel then transfers the received heat and humidity to the incoming relatively cool, dry, fresh air that is passing through the enthalpy wheel and traveling along air flow path A. Thus, the incoming air is always conditioned to be at approximately the same temperature and humidity as the indoor air, thereby placing minimal burden on the separate air conditioning or heating unit for that room.

A non-limiting example of a fresh air supply unit according to the present invention, which did not include a thermoelectric chip, was tested. The results of the test are as follows:

| # | ITEM | MODE OF OPERATION COOLING | HEATING |
|---|---|---|---|
| 1 | INDOOR ROOM CONDITIONS | | |
| | Dry Bulb | 75° F. | 70° F. |
| | Wet Bulb | 63° F. | 58° F. |
| | Relative Humidity | 50% | 50% |
| 2 | OUTDOOR CONDITIONS | | |
| | Dry Bulb | 95° F. | 35° F. |
| | Wet Bulb | 75° F. | 33° F. |
| | Relative Humidity | 40% | 80% |
| 3 | AIRFLOW | | |
| | Exhaust | 150 cfm | 150 cfm |
| | Intake Fresh Air | 115 cfm | 115 cfm |
| 4 | WHEEL SPEED | 57 rpm | 57 rpm |
| 5 | SUPPLY AIR TO INDOOR ROOM | | |
| | Dry Bulb | 78.6° F. | 62.2° F. |
| | Wet Bulb | 65.1° F. | 52° F. |
| | Relative Humidity | 48% | 50% |
| 6 | ENERGY RECOVERY EFFICIENCY – "E" | 82% | 76.50% |

where:

$$\text{Efficiency or Effectiveness} = E = \frac{W_S(X_1 - X_2)}{W_{MIN}(X_1 - X_3)}$$

where:

E—Sensible, latent or total heat effectiveness;

X—Dry Bulb temperature, humidity ratio or total enthalpy;

$W_S$—Supply mass flow rate of air along air flow path A;

$W_E$—Exhaust mass flow rate of air along air flow path B; and $W_{MIN}$—Minimum of $W_S$ and $W_E$.

Figure 5:
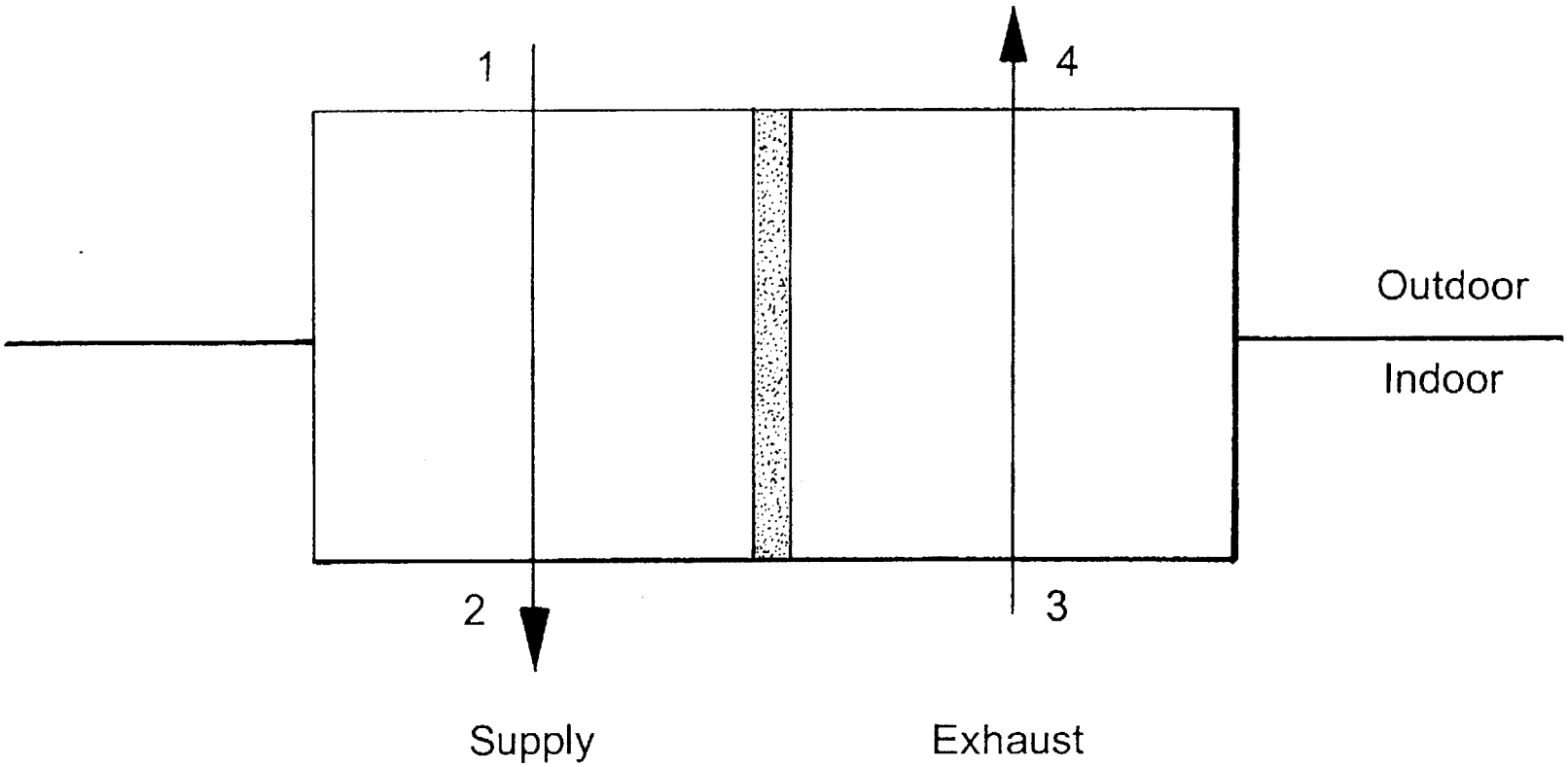
FIG. 5 is a schematic view of the fresh air supply unit.

Locations 1, 2, 3 and 4 are the locations with respect to the fresh air supply unit 10 illustrated in FIG. 5.

Having described the presently preferred exemplary embodiment method and apparatus for supplying conditioned fresh air in accordance with the present invention, it is believed that other modifications, variations and changes will be suggested to those skilled in the art in view of the teachings set forth herein. It is, therefore, to be understood that all such modifications, variations, and changes are believed to fall within the scope of the present invention as defined by the appended claims.

What is claimed is:

1. A fresh air supply unit comprising:

a housing having a first side and a second side, a first opening being disposed in said first side, a second opening and a third opening being disposed in said second side;

an enthalpy wheel having a first side facing surface and an opposite second side facing surface, said enthalpy wheel being rotatably mounted within said housing, approximately half of said second side facing surface being in fluid communication with said second opening, approximately the remaining half of said second side facing surface being in fluid communication with said third opening, substantially the entire first side facing surface being in fluid communication with said first opening;

a partition being disposed in said housing between a predetermined location on said second side of said housing between said second opening and said third opening and extending to said enthalpy wheel to define, in part, a first air flow path and a second air flow path within the housing, said first air flow path extending between said second opening through said enthalpy wheel to said first opening, said second air flow path extending from said first opening through said enthalpy wheel to said third opening; and a heater being disposed within said housing in said first air flow path.

2. The fresh air supply unit as recited in claim 1, further comprising a first fan being mounted within said housing in fluid communication with said second opening.

3. The fresh air supply unit as recited in claim 2, further comprising a second fan being mounted within said housing in fluid communication with said third opening.

4. The fresh air supply unit as recited in claim 3, further comprising a filter being disposed within said housing in said first air flow path between said second opening and said first fan.

5. The fresh air supply unit as recited in claim 4, wherein said filter is a washable electrostatic filter.

6. The fresh air supply unit as recited in claim 4, wherein said filter is a disposable filter.

7. The fresh air supply unit as recited in claim 4, wherein said filter is a washable, reusable filter.

8. The fresh air supply unit as recited in claim 3, wherein said first fan and said second fan are driven by a common motor.

9. The fresh air supply unit as recited in claim 3, wherein said first fan is driven by a first motor and said second fan is driven by a second motor.

10. The fresh air supply unit as recited in claim 1, wherein said enthalpy wheel is rotatably driven by a belt drive.

11. The fresh air supply unit as recited in claim 1, wherein said heater is disposed in said first air flow path between said first fan and said enthalpy wheel.

12. A fresh air supply unit comprising:

a housing having a first side and a second side, a first opening being disposed in said first side, a second opening and a third opening being disposed in said second side;

an enthalpy wheel having a first side facing surface and an opposite second side facing surface, said enthalpy wheel being rotatably mounted within said housing, approximately half of said second side facing surface being in fluid communication with said second opening, approximately the remaining half of said second side facing surface being in fluid communication with said third opening, substantially the entire first side facing surface being in fluid communication with said first opening; and a partition being disposed in said housing between a predetermined location on said second side of said housing between said second opening and said third opening and extending to said enthalpy wheel to define, in part, a first air flow path and a second air flow path within the housing, said first air flow path extending between said second opening through said enthalpy wheel to said first opening, said second air flow path extending from said first opening through said enthalpy wheel to said third opening, a thermoelectric chip being disposed in said partition, said thermoelectric chip having a first surface in fluid communication said first air flow path and a second surface in fluid communication said second air flow path.

13. A fresh air supply unit comprising:

a housing having a first side and a second side, a first opening being disposed in said first side, a second opening and a third opening being disposed in said second side;

an enthalpy wheel having a first side facing surface and an opposite second side facing surface, said enthalpy wheel being rotatably mounted within said housing, approximately half of said second side facing surface being in fluid communication with said second opening, approximately the remaining half of said second side facing surface being in fluid communication with said third opening, substantially the entire first side facing surface being in fluid communication with said first opening; and a first air flow path and a second air flow path being defined within the housing, said first air flow path extending between said second opening through said enthalpy wheel to said first opening, said second air flow path extending from said first opening through said enthalpy wheel to said third opening, wherein the ratio of air flow through said first air flow path to air flow through said second air flow path is less than 85%.

14. The fresh air supply unit as recited in claim 13, wherein the ratio of air flow through said first air flow path to air flow through said second air flow path ranges from about 65% to about 85%.

15. The fresh air supply unit as recited in claim 14, wherein said ratio ranges from about 70% to about 80%.

16. The fresh air supply unit as recited in claim 15, wherein said ratio is about 76%.

17. The fresh air supply unit as recited in claim 14, further comprising a first fan being mounted within said housing in fluid communication with said second opening.

18. The fresh air supply unit as recited in claim 17, further comprising a second fan being mounted within said housing in fluid communication with said third opening.

19. The fresh air supply unit as recited in claim 18, further comprising a filter being disposed within said housing in said first air flow path between said second opening and said first fan.

20. The fresh air supply unit as recited in claim 19, wherein said filter is a washable electrostatic filter.

21. The fresh air supply unit as recited in claim 19, wherein said filter is a disposable filter.

22. The fresh air supply unit as recited in claim 20, wherein said filter is a washable, reusable filter.

23. The fresh air supply unit as recited in claim 18, wherein said first fan and said second fan are driven by a common motor.

24. The fresh air supply unit as recited in claim 18, wherein said first fan is driven by a first motor and said second fan is driven by a second motor.

25. The fresh air supply unit as recited in claim 13, wherein said enthalpy wheel is rotatably driven by a belt drive.

26. The fresh air supply unit as recited in claim 13, further comprising a heater being disposed within said housing in said first air flow path.

27. The fresh air supply unit as recited in claim 26, wherein said heater is disposed in said first air flow path between said first fan and said enthalpy wheel.

28. A fresh air supply unit comprising:

a housing having a first side and a second side, a first opening being disposed in said first side, a second opening and a third opening being disposed in said second side;

an enthalpy wheel having a first side facing surface and an opposite second side facing surface, said enthalpy wheel being rotatable mounted within said housing, approximately half of said second side facing surface being in fluid communication with said second opening, approximately the remaining half of said second side facing surface being in fluid communication with said third opening, substantially the entire first side facing surface being in fluid communication with said first opening;

a first air flow path and a second air flow path being defined within the housing, said first air flow path extending between said second opening through said enthalpy wheel to said first opening, said second air flow path extending from said first opening through said enthalpy wheel to said third opening; and a partition being disposed in said housing between a predetermined location on said second side of said housing between said second opening and said third opening and extending to said enthalpy wheel to define, in part, a thermoelectric chip being disposed in said partition, said thermoelectric chip having a first surface in fluid communication said first air flow path and a second surface in fluid communication said second air flow path.

29. A method of conditioning air utilizing a fresh air supply unit that includes a housing having a first side and a second side, a first opening being disposed in the first side, a second opening and a third opening being disposed in said second side, an enthalpy wheel being rotatably mounted within said housing, a partition being disposed in said housing between a predetermined location on said second side of the housing between said second opening and said third opening and extending to said enthalpy wheel to define, in part, a first air flow path and a second air flow path, said first air flow path extending between said second opening through said enthalpy wheel to said first opening, said second air flow path extending between said first opening through said enthalpy wheel to said third opening, the method comprising the steps of:

passing fresh air through the housing, along said first air flow path, into said second opening, through said enthalpy wheel and out of said first opening;

passing stale air through the housing, along said second air flow path, into said first opening, through said enthalpy wheel and out of said third opening such that a ratio of air flow through said first air flow path to air flow through said second air flow path is less than 85%.

30. The method of claim 29, further comprising the steps of:

in a cooling mode, transferring to the stale air moisture and heat from said fresh air; and in a heating mode, transferring to the fresh air heat and moisture from the stale air.

31. The method of claim 29, further comprising the step of heating the air in the first air flow path.

32. The method of claim 29, wherein a ratio of air flow through said first air flow path to air flow through said second air flow path ranges from about 65% to about 85%.

33. The method of claim 32, wherein said ratio ranges from about 70% to about 80%.

34. The method of claim 33, wherein said ratio is about 76%.

35. The fresh air supply unit as recited in claim 1, further comprising a temperature sensor disposed within said housing for monitoring a temperature of the air flowing in said first air flow path to selectively actuate said heater.

* * * * *